US010294895B2

(12) United States Patent
Shirai

(10) Patent No.: US 10,294,895 B2
(45) Date of Patent: May 21, 2019

(54) ABNORMALITY SENSING DEVICE FOR EVAPORATION FUEL PURGE SYSTEM

(71) Applicants: HAMANAKODENSO CO., LTD., Kosai, Shizuoka-pref. (JP); DENSO CORPORATION, Kariya, Aichi-pref. (JP)

(72) Inventor: Kosuke Shirai, Toyohashi (JP)

(73) Assignees: HAMANAKODENSO CO., LTD., Kosai (JP); DENSO CORPORATION, Kariya (JP)

( * ) Notice: Subject to any disclaimer, the term of this patent is extended or adjusted under 35 U.S.C. 154(b) by 224 days.

(21) Appl. No.: 14/792,903

(22) Filed: Jul. 7, 2015

(65) Prior Publication Data

US 2016/0017849 A1 Jan. 21, 2016

(30) Foreign Application Priority Data

Jul. 15, 2014 (JP) ..... 2014-145150

(51) Int. Cl.
*F02M 25/08* (2006.01)
*F02D 41/00* (2006.01)
*F02M 35/10* (2006.01)

(52) U.S. Cl.
CPC ..... *F02M 25/0809* (2013.01); *F02D 41/004* (2013.01); *F02M 25/089* (2013.01);
(Continued)

(58) Field of Classification Search
CPC ..... F02M 25/0809; F02M 25/0818; F02M 25/0836; F02M 25/0854; F02M 25/089; F02M 35/10222; F02D 41/004
(Continued)

(56) References Cited

U.S. PATENT DOCUMENTS 1,490,581 A 4/1924 Bell
5,592,923 A * 1/1997 Machida ..... F02M 25/0809 123/520
(Continued)

FOREIGN PATENT DOCUMENTS

DE 102 09 432 9/2003
DE 10 2009 009 898 8/2010
(Continued)

OTHER PUBLICATIONS

European Search Report dated Dec. 7, 2015 issued in corresponding European Application No. 15173148.6 (6 pages).

*Primary Examiner* — David E Hamaoui
*Assistant Examiner* — Susan E Scharpf
(74) *Attorney, Agent, or Firm* — Nixon & Vanderhye PC

(57) ABSTRACT

An abnormality sensing device for an evaporation fuel purge system is equipped with a purge passage that connects a canister to an intake passage of an internal combustion engine, a purge pump, a purge control valve, and a valve component that closes and opens the purge passage at a target passage including at least a first purge passage defined between the purge control valve and the intake passage. An abnormality determining portion detects a physical quantity relevant to a pressure change in the target passage in a determination possible state where the purge control valve allows the evaporation fuel to flow through the first purge passage and where the valve component prohibits the evaporation fuel from being supplied to the intake passage.

11 Claims, 10 Drawing Sheets

(52) U.S. Cl.
CPC .... *F02M 25/0818* (2013.01); *F02M 25/0836* (2013.01); *F02M 25/0854* (2013.01); *F02M 35/10222* (2013.01)

(58) Field of Classification Search
USPC ..... 123/520
See application file for complete search history.

(56) References Cited

U.S. PATENT DOCUMENTS 5,890,474 A * 4/1999 Schnaibel ..... F02M 25/0818 123/198 D
6,523,398 B1 * 2/2003 Hanai ..... F02M 25/0809 73/114.39
6,695,895 B2 * 2/2004 Hyodo ..... F02M 25/089 123/519
6,722,348 B2 * 4/2004 Nagasaki ..... F02M 25/0818 123/198 D
6,848,298 B2 * 2/2005 Miyahara ..... F02M 25/0818 702/51
7,036,359 B2 * 5/2006 Hayakawa ..... F02M 25/0809 73/114.39
7,165,446 B2 * 1/2007 Miyahara ..... F02M 25/08 73/114.39
7,165,447 B2 * 1/2007 Miyahara ..... F02M 25/08 73/114.39
7,363,803 B2 * 4/2008 Hayakawa ..... F02M 25/0809 123/499
7,367,326 B2 * 5/2008 Shikama ..... F02M 25/0809 123/198 D
7,383,826 B2 * 6/2008 Kano ..... F02M 25/08 123/518
7,762,126 B2 * 7/2010 Shibuya ..... F02D 41/0032 123/198 D
9,476,793 B2 * 10/2016 Takakura ..... F02M 25/0818
9,494,481 B2 * 11/2016 Takakura ..... F02M 25/0818
2005/0115615 A1 * 6/2005 Takayanagi ..... F02M 25/0872 137/515
2007/0239330 A1 * 10/2007 Baumann ..... F02M 25/0818 701/33.7
2008/0264156 A1 * 10/2008 Streib ..... G01M 3/32 73/114.43
2010/0223984 A1 * 9/2010 Pursifull ..... F02M 25/0836 73/114.39
2010/0224171 A1 * 9/2010 Peters ..... F02M 25/0836 123/520
2012/0031380 A1 * 2/2012 Mai ..... F02M 25/0836 123/520
2013/0269661 A1 * 10/2013 Senda ..... F02M 25/0836 123/520
2013/0319378 A1 * 12/2013 Haag ..... B60K 15/03504 123/519
2014/0116401 A1 * 5/2014 Horiba ..... F02M 25/0809 123/520
2014/0174411 A1 * 6/2014 Matsunaga ..... F02M 25/0809 123/520
2014/0345574 A1 * 11/2014 Haefele ..... F02M 25/0809 123/519
2015/0240772 A1 * 8/2015 Yamamoto ..... F02D 41/1459 73/40.5 R
2015/0361929 A1 * 12/2015 Tamura ..... F02M 25/0809 73/114.39
2016/0017849 A1 * 1/2016 Shirai ..... F02D 41/004 123/520
2016/0356247 A1 * 12/2016 Dudar ..... F02M 25/0827
2017/0002761 A1 * 1/2017 Dudar ..... F02D 41/22

FOREIGN PATENT DOCUMENTS

JP 62-175263 11/1987
JP 7-19364 1/1995
JP 7-217763 8/1995
JP 2002-349364 12/2002
JP 2010-019212 1/2010

* cited by examiner

ABNORMALITY SENSING DEVICE FOR EVAPORATION FUEL PURGE SYSTEM

CROSS REFERENCE TO RELATED APPLICATION

This application is based on Japanese Patent Application No. 2014-145150 filed on Jul. 15, 2014, the disclosure of which is incorporated herein by reference in its entirety.

TECHNICAL FIELD

The present disclosure relates to an abnormality sensing device for an evaporation fuel purge system.

BACKGROUND

JP 2002-349364A describes a gas leak sensing device for an evaporation fuel purge system, which detects abnormality generated in components of the system such as fuel tank, canister, or piping.

The gas leak sensing device drives a purge pump to lower the pressure in the system in the state where the purge control valve is open and where a valve for a canister is closed. Then, the purge pump is stopped and the purge control valve is closed when a predetermined time is elapsed after the purge pump is stopped, such that the purge system is in the tightly closed state with negative pressure. Under this situation, when the pressure increasing speed in the purge system is relatively large, it is determined that there is an abnormality such as leak in the purge system. For example, if a crack is generated in a piping of the system, outside air flows into the purge system. When the pressure increasing speed in the purge system is relatively small, it assumes that the pressure increase is based on only evaporation of fuel in a fuel tank, and it is determined that the purge system is normal.

The gas leak sensing device is able to detect an abnormality such as leak in a passage between a fuel tank and a purge control valve. However, the gas leak sensing device is not able to detect an abnormality such as leak in a passage, for example, a hose which connects a purge control valve to an intake passage of an internal combustion engine.

SUMMARY

It is an object of the present disclosure to provide an abnormality sensing device for an evaporation fuel purge system, which is able to detect an abnormality such as leak in a passage connecting a purge control valve to an intake passage of an internal combustion engine.

According to an aspect of the present disclosure, an abnormality sensing device for an evaporation fuel purge system includes: a fuel tank storing fuel; a canister that adsorbs evaporation fuel generated in the fuel tank and that desorbs the evaporation fuel; an intake passage of an internal combustion engine in which the evaporation fuel desorbed from the canister is mixed with fuel for combustion to be combusted; a purge passage that connects the canister to the intake passage of the internal combustion engine; a purge pump that pumps the evaporation fuel in the canister to the intake passage of the internal combustion engine; a purge control valve disposed in the purge passage to control a flow of the evaporation fuel pumped by the purge pump to flow through the purge passage; a valve component that closes and opens the purge passage to control the evaporation fuel to flow into the intake passage of the internal combustion engine at a target passage including at least a first purge passage defined between the purge control valve and the intake passage of the internal combustion engine; and an abnormality determining portion that determines whether there is an abnormality in the evaporation fuel purge system in a state where the evaporation fuel is pumped by the purge pump toward the intake passage of the internal combustion engine. The abnormality determining portion is in a determination possible state when the evaporation fuel is pumped toward the intake passage of the internal combustion engine by the purge pump, when the purge control valve allows the evaporation fuel to flow through the first purge passage, and when the valve component prohibits the evaporation fuel from being supplied to the intake passage of the internal combustion engine. In the determination possible state, the abnormality determining portion detects a predetermined physical quantity relevant to a pressure change in the target passage, and determines whether there is an abnormality in the evaporation fuel purge system according to the predetermined physical quantity.

Thus, a leak generated in the target passage including the first purge passage that connects the purge control valve to the intake passage of the internal combustion engine can be detected according to the detection value of the predetermined physical quantity relevant to the pressure change in the target passage. An abnormality in the purge system can be detected in the wide range of the purge passage from the purge control valve to an end of the purge passage that is connected to the intake passage of the internal combustion engine. Since the abnormality can be detected while the purge pump is operated, it is possible to detect the abnormality while the internal combustion engine is operated or stopped. Therefore, since an abnormality can be suitably detected even if the internal combustion engine is operated, an abnormality such as leak is detectable at early stage.

Accordingly, the abnormality sensing device is provided for the evaporation fuel purge system, which can detect a leak generated in the target passage including the first purge passage that connects the purge control valve to the intake passage of the internal combustion engine.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
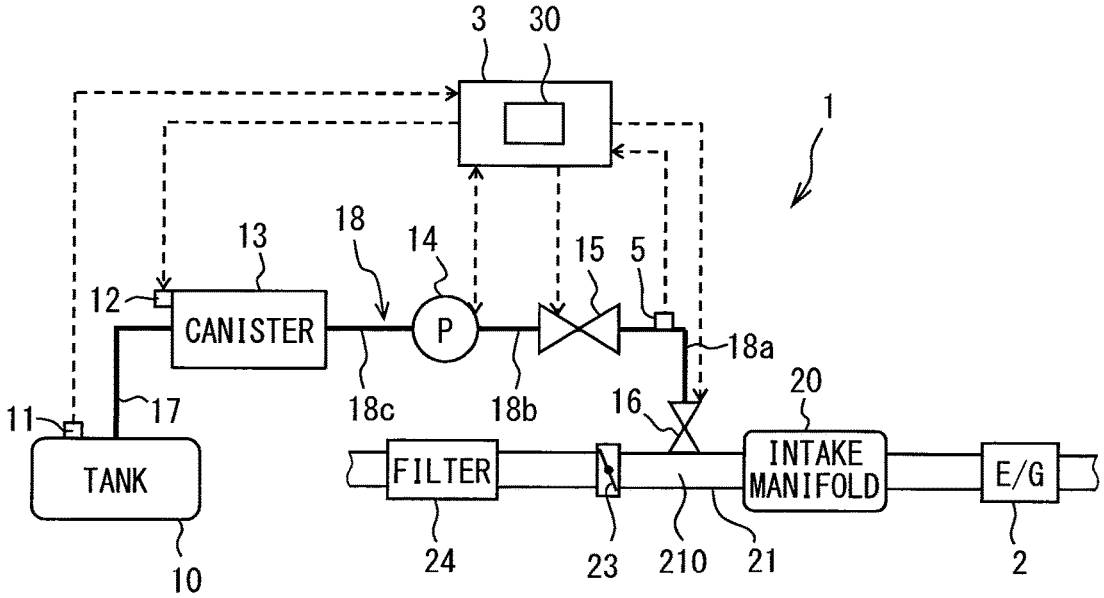
FIG. 1 is a block diagram illustrating an abnormality sensing device for an evaporation fuel purge system according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

An evaporation fuel purge system 1 according to a first embodiment is explained referring to FIGS. 1-7. The evaporation fuel purge system 1 has a canister 13 that adsorbs, for example, HC gas in fuel, and supplies the HC gas to an intake passage 210 of an internal combustion engine. Evaporation fuel evaporated from a fuel tank 10 is prevented from being emitted to the atmosphere, due to the evaporation fuel purge system 1.

As shown in FIG. 1, the evaporation fuel purge system 1 is combined to an intake system for the internal combustion engine 2, and the intake passage 210 of the internal combustion engine is defined in the intake system. The evaporation fuel purge system 1 supplies evaporation fuel to the intake system of the internal combustion engine 2.

The evaporation fuel introduced into the intake passage 210 of the internal combustion engine 2 is mixed with fuel for combustion supplied to the internal combustion engine 2 from an injector, and is combusted in the cylinder of the internal combustion engine 2. The intake system has an intake manifold 20 corresponding to a part of the intake passage 210 of the internal combustion engine, an intake pipe 21, a throttle valve 23, and an air filter 24. The air filter 24 is disposed in the intake pipe 21 that is connected to the intake manifold 20 through the throttle valve 23.

In the evaporation fuel purge system, the canister 13 and the fuel tank 10 are connected with each other through a vapor passage 17, and the canister 13 is connected to the intake passage 210 of the internal combustion engine through a purge passage 18. The purge passage 18 has a first purge passage 18*a* which connects the purge control valve 15 to the intake passage 210 of the internal combustion engine and a second purge passage 18*b* which connects the purge control valve 15 to the purge pump 14.

The air filter 24 is arranged at the upstream part of the intake pipe 21, and catches dust in intake air. The throttle valve 23 controls the opening degree at the inlet part of the intake manifold 20 based on an instruction from an accelerator, so as to control the amount of intake air which flows into the intake manifold 20. Intake air passes the air filter 24 and the throttle valve 23 in this order to flow into the intake manifold 20, and is mixed with fuel for combustion injected from an injector to be combusted in a cylinder with a predetermined air/fuel ratio.

The fuel tank 10 is a container which stores fuel such as gasoline. The fuel tank 10 is connected to the inflow part of the canister 13 by piping which defines the vapor passage 17. Adsorption material such as activated carbon is filled inside the canister 13. Evaporation fuel generated in the fuel tank 10 is taken into the canister 13 through the vapor passage 17 and is temporarily adsorbed onto the adsorption material. A canister closing valve 12 (CCV 12) is disposed for the canister 13 to open and close the intake part for drawing external fresh air. Atmospheric pressure can be applied into the canister 13, due to CCV 12. The canister 13 can easily desorb and purge the evaporation fuel from the adsorption material due to the fresh air.

The evaporation fuel desorbed from the adsorption material flows out of the canister 13 through the outflow part, and an end of piping which defines a third purge passage 18*c* is connected to the outflow part of the canister 13. The other end of the piping which defines the third purge passage 18*c* is connected to the inflow part of the purge pump 14.

The purge pump 14 and the purge control valve 15 are connected with each other by the second purge passage 18*b*. The purge control valve 15 is connected and communicated to the intake passage 210 of the internal combustion engine by a duct 18*aa* which defines the first purge passage 18*a*. Thus, the purge passage 18 includes the third purge passage 18*c*, the second purge passage 18*b*, and the first purge passage 18*a* in this order from the canister 13 to the intake passage 210 of the internal combustion engine.

The purge pump 14 is a fluid drive portion equipped with a turbine rotated by a motor, and sends the evaporation fuel from the canister 13 toward the intake passage 210 of the internal combustion engine. The purge control valve 15 is an opening-and-closing portion to open and close the second purge passage 18*b* and the first purge passage 18*a*, i.e., the evaporation fuel supply passage. When the second purge passage 18*b* and the first purge passage 18*a* are open, the evaporation fuel can be supplied from the canister 13 to the internal combustion engine 2. When the second purge passage 18*b* and the first purge passage 18*a* are closed, the supply of the evaporation fuel from the canister 13 to the internal combustion engine 2 is prohibited.

The purge control valve 15 may be an electromagnetic valve equipped with a valve object, an electromagnetic coil, and a spring. The opening of the purge control valve 15 is controlled by a control device 3. The purge control valve 15 opens and closes the evaporation fuel supply passage based on the balance between the biasing force of the spring and the electromagnetic force generated when the electromagnetic coil is energized.

The purge control valve 15 usually maintains the state where the evaporation fuel supply passage is closed. When electricity is supplied to the electromagnetic coil by the control device 3, the electromagnetic force becomes larger than the elastic force of the spring to maintain the state where the evaporation fuel supply passage is opened. The control device 3 energizes the electromagnetic coil by controlling the duty ratio, i.e., the ratio of ON time to the time of one cycle constructed of the ON time and the OFF time. The purge control valve 15 may be referred to a duty control valve. The flow rate of evaporation fuel flowing through the evaporation fuel supply passage is adjusted by controlling the electricity supplied to the electromagnetic coil.

The electromagnetic valve 16 corresponds to a valve component arranged at a connection part where the first purge passage 18*a* and the intake passage 210 of the internal combustion engine are connected to each other. The electromagnetic valve 16 is able to allow evaporation fuel to flow into the intake passage 210 from the target passage of the purge passage 18 which includes at least the first purge passage 18*a* that is defined between the connection part and the purge control valve 15, or to prohibit evaporation fuel from flowing into the intake passage 210 from the target passage.

The target passage is a passage set for the abnormality sensing device of the evaporation fuel purge system 1 to detect an abnormality such as disconnection of duct or hose. The abnormality includes a hole or crack generated in duct or hose. The target passage is set to include at least the first purge passage 18*a* defined between the electromagnetic valve 16 and the purge control valve 15. Furthermore, the target passage may include the second purge passage 18*b* defined between the purge pump 14 and the purge control valve 15, when the purge control valve 15 is closed to stop the flow of evaporation fuel such that the evaporation fuel is prevented from flowing into the intake passage 210 of the internal combustion engine.

When voltage is not impressed, the electromagnetic valve 16 is open to open the passage. When voltage is impressed, the electromagnetic valve 16 is closed to close the passage. Normally, voltage is not impressed, and the electromagnetic valve 16 is open.

Figure 2:
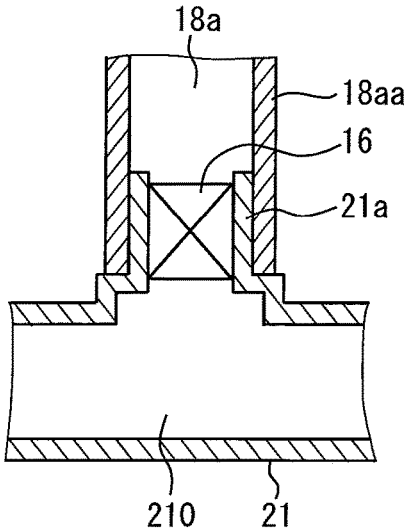
FIG. 2 is an enlarged view illustrating an electromagnetic valve in the first embodiment.

As shown in FIG. 2, the electromagnetic valve 16 is disposed in the intake pipe 21 corresponding to a duct component which forms the intake passage 210 of the internal combustion engine. The electromagnetic valve 16 is disposed inside of a cylindrical connector 21*a* of the intake pipe 21 that has a cylindrical shape extending in the direction intersecting the axis of the intake passage 210, and is able to fully close the passage in the cylindrical connector 21*a*. Thus, the electromagnetic valve 16 is arranged not in a duct 18*aa* that forms the first purge passage 18*a* but in the intake pipe 21 that forms the intake passage 210 of the internal combustion engine. The cylindrical connector 21*a* of the intake pipe 21 is fitted into the end portion of the duct 18*aa*, and the electromagnetic valve 16 is located at an overlap part where the cylindrical connector 21*a* and the duct 18*aa* overlap with each other.

When the electromagnetic valve 16 is controlled to be in the closed state, evaporation fuel can fill the whole passage in the duct 18*aa*. Therefore, if a hole is generated in the duct 18*aa* in the state where the electromagnetic valve 16 fully closes the passage in the cylindrical connector 21*a*, the filled evaporation fuel certainly leaks to outside through the hole. The evaporation fuel purge system 1 is able to detect the leak of the evaporation fuel, as an abnormality, in this state, such that it is determined that an abnormality occurs in the purge system.

The control device 3 is an electronic control unit of the evaporation fuel purge system 1. The control device 3 is equipped with a microcomputer including a CPU (central processing unit) that performs calculation and control processing, a memory such as ROM and RAM, and an input/output circuit (I/O port). The control device 3 performs basic control, such as fuel purge in the evaporation fuel purge system 1, and also determines whether there is abnormality in the purge system by the abnormality determination circuit 30. The control device 3 is connected to control each actuator of the purge control valve 15, CCV 12, and the electromagnetic valve 16.

The evaporation fuel purge system 1 is equipped with a pressure sensor 5 which detects the pressure in the first purge passage 18*a*. The evaporation fuel purge system 1 can detect the pressure in a piping which forms the first purge passage 18*a* in the area from the purge control valve 15 to the electromagnetic valve 16 using the detection value of the pressure sensor 5.

The control device 3 is connected to the motor of the purge pump 14, and controls the purge pump 14 to operate or stop by driving the motor regardless of operation of the internal combustion engine 2. The input port of the control device 3 receives signals related to the number of rotations of the internal combustion engine 2, the amount of intake air, the temperature of cooling water, and the signal corresponding to the internal pressure of the fuel tank 10 from the pressure sensor 11. Furthermore, the signal corresponding to the pressure of the first purge passage 18*a* detected by the pressure sensor 5 is inputted into the input port of the control device 3.

Evaporation fuel drawn from the canister 13 to the intake manifold 20 is mixed with fuel for combustion supplied to the internal combustion engine 2 from an injector, and is combusted within the cylinder of the internal combustion engine 2. In the cylinder of the internal combustion engine 2, the air/fuel ratio between fuel for combustion and intake air is controlled to have a predetermined value. By carrying out the duty control of the opening-and-closing time of the purge control valve 15, while the evaporation fuel is purged, the control device 3 adjusts the purge amount of evaporation fuel to maintain the predetermined air/fuel ratio.

The evaporation fuel purge system 1 prevents emission of evaporation fuel generated in the fuel tank 10 to the atmosphere. However, if a gap such as hole is generated in the evaporation fuel purge system, the evaporation fuel will leak from the gap to the atmosphere. Such a leak does not cause influence in operation of the internal combustion engine 2, and the driver of the vehicle may not be able to find the abnormality. So, in the first embodiment, the existence of abnormality such as fuel leak in the purge system is determined and reported quickly at an early stage.

Figure 4:
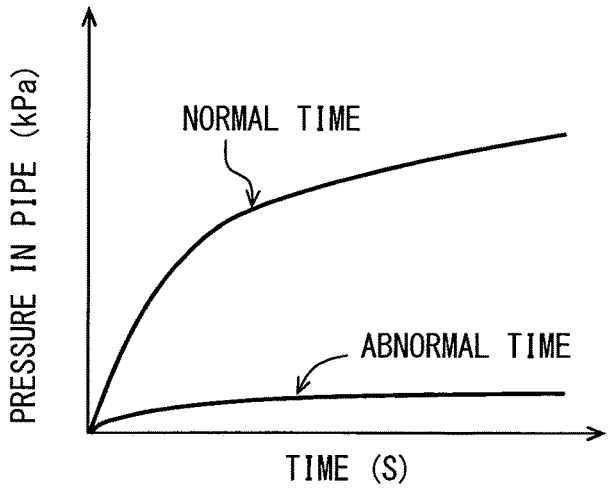
FIG. 4 is a graph illustrating a relationship between time and pressure change in a pipe defining a target passage in the first embodiment.

The evaporation fuel purge system 1 detects change in physical quantity relevant to the pressure in the target passage, and determines whether the change is within the normal range. The graph of FIG. 4 illustrates pressure change at the normal time and the abnormal time, as to the pressure of the first purge passage 18*a* and the pressure of the second purge passage 18*b*, in the state where evaporation fuel is pumped with the purge pump 14. A specific curve can be recognized in the physical quantity (pressure change) relative to each of the normal time and the abnormal time. For example, the physical quantity may be pressure measured at the first purge passage 18*a*, pressure measured at the second purge passage 18*b*, or power consumption, consumption current, consumption voltage of the purge pump 14.

Figure 5:
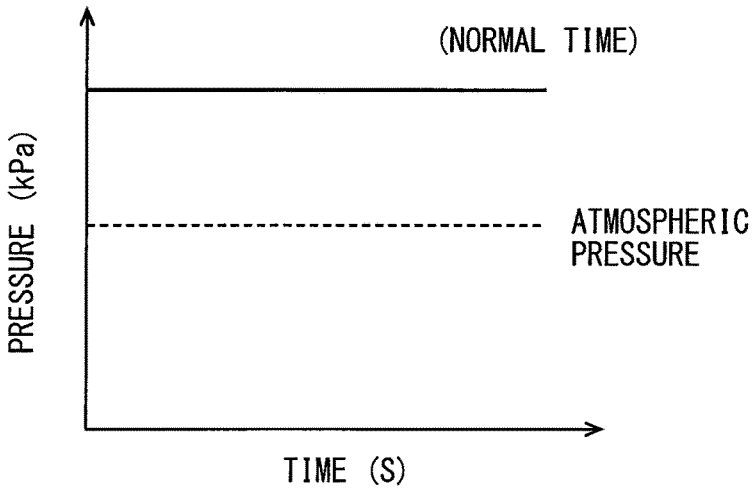
FIG. 5 is a graph illustrating a pressure change in a first purge passage that is in a closed state at a normal time.
Figure 6:
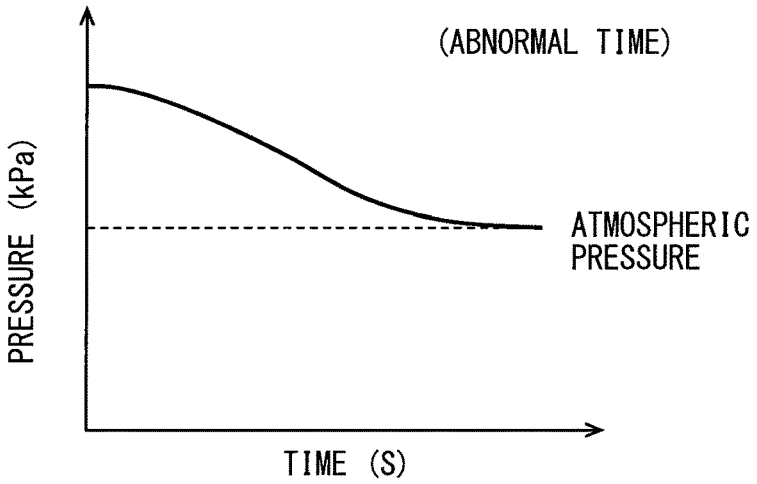
FIG. 6 is a graph illustrating a pressure change in a first purge passage that is in a closed state at an abnormal time.

The evaporation fuel purge system 1 detects change of the physical quantity relevant to the pressure in the target passage, and determines whether the change is within the normal range. The graph of FIG. 5 illustrates a pressure change of the first purge passage 18*a* that is closed at the normal time. The graph of FIG. 6 illustrates a pressure change of the first purge passage 18*a* that is closed at the abnormal time. The physical quantity relevant to the pressure change in this case is, for example, the pressure measured at the first purge passage 18*a*.

Figure 3:
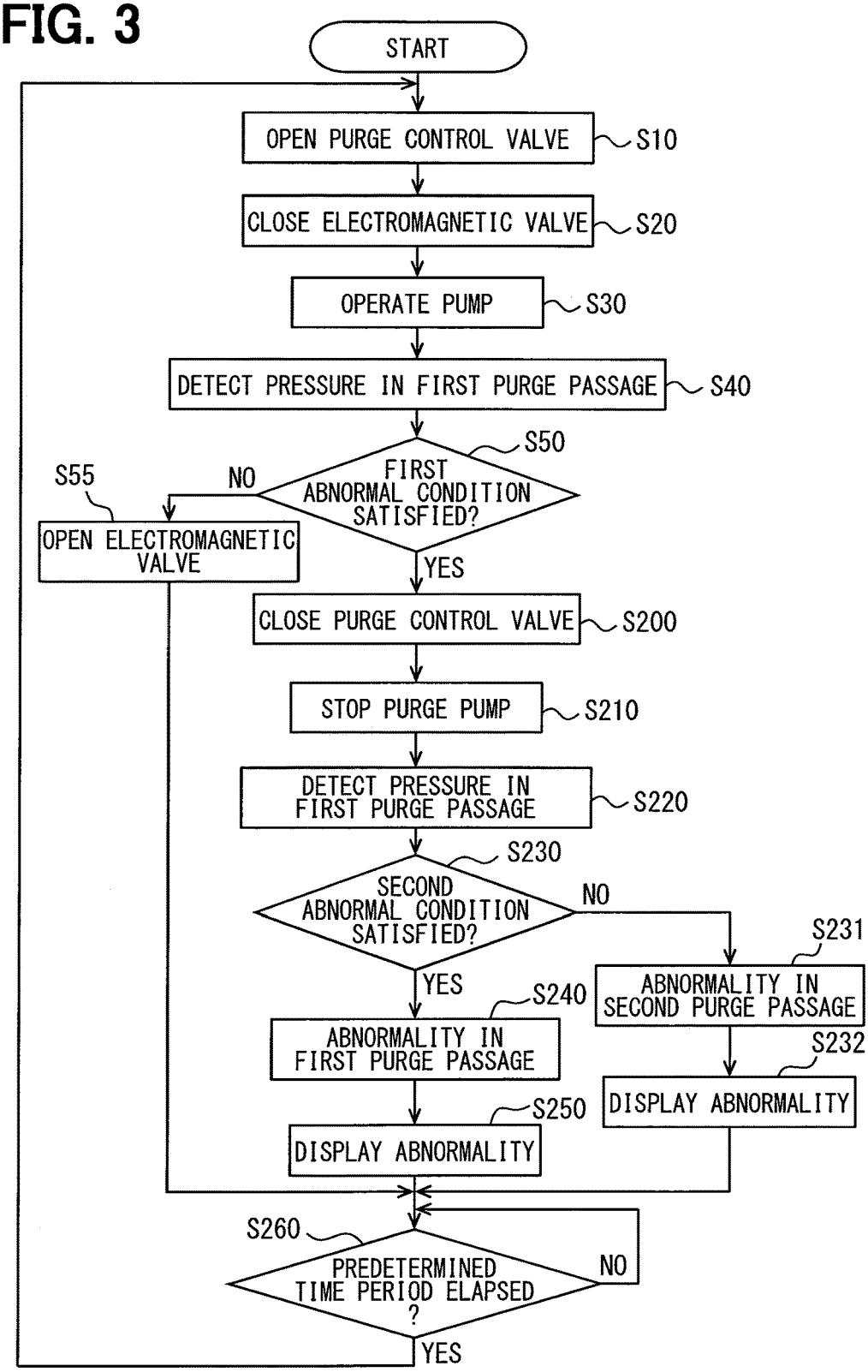
FIG. 3 is a flow chart explaining a determination process by the abnormality sensing device in the first embodiment.

An abnormality detection control according to the first embodiment is explained with reference to the flow chart of FIG. 3. The control device 3 performs processing according to the flow chart of FIG. 3. The flow chart operates when the vehicle is stopped or when the vehicle is travelling with the operation of the internal combustion engine 2. That is, the abnormality detection control of the evaporation fuel purge system 1 is periodically performed irrespective of ON and OFF of the internal combustion engine 2.

When the flow chart is started, the control device 3 controls the purge control valve 15 to open at S10, controls the electromagnetic valve 16 to close at S20, and operates the purge pump 14 at S30. Since the evaporation fuel pumped with the purge pump 14 is stopped and dammed at the position of the electromagnetic valve 16, the first purge passage 18*a* and the second purge passage 18*b* are in the closed state with a positive pressure.

The control device 3 keeps this state for a predetermined time period, so as to provide a detection possible state where it is possible to detect the existence of abnormality in the target passage. At S40, the control device 3 acquires the pressure signal of the first purge passage 18*a* detected by the pressure sensor 5, and detects the pressure in the first purge passage 18*a*.

The abnormality determination circuit 30 of the control device 3 determines whether a first abnormality condition is satisfied at S50. The first abnormality condition is a condition for determining whether an abnormality such as leak is occurred in the target passage (the first purge passage 18*a* and the second purge passage 18*b*) in the determination possible state.

In this state, when there is no leak in the first purge passage 18*a* and the second purge passage 18*b*, the pressure in the passage is rapidly increased by operation of the purge pump 14, as shown in the pressure change at the normal time of FIG. 4. Then, the pressure in the passage is gradually increased with continuation of operation.

On the contrary, if there is a leak is in the target passage, evaporation fuel leaks outside, as shown in the pressure change at the abnormal time of FIG. 4, the pressure increase in the passage is smaller than that at the normal time, after operation of the purge pump 14.

The first abnormality condition shall be satisfied, for example, when the pressure change per unit time (rate of pressure change) is less than a first predetermined value that is defined beforehand. Therefore, when the rate of pressure change is smaller than the first predetermined value, the abnormality determination circuit 30 determines that there is abnormality. When the rate of pressure change is larger than or equal to the first predetermined value, the abnormality determination circuit 30 determines that there is no abnormality.

When the abnormality determination circuit 30 determines that the first abnormality condition is not satisfied at S50, the abnormality detection control should be ended, because there is no abnormality. So, the control device 3 controls the electromagnetic valve 16 to open at S55 and progresses to S260. At S260, it is determined whether a predetermined time period is elapsed after the processing of S50. That is, the processing of S260 is repeatedly performed until the next determination timing comes. When it is determined that the predetermined time period has passed at S260, the abnormality determination circuit 30 returns to S10 and again performs the processing of abnormality detection control. Thus, the abnormality detection control of the evaporation fuel purge system 1 is performed at interval of predetermined time irrespective of whether the internal combustion engine 2 is operating or not.

When the abnormality determination circuit 30 determines that the first abnormality condition is satisfied at S50, the position of the abnormality should be detected in detail, so the control device 3 controls the purge control valve 15 to close at S200, and suspends the purge pump 14 at S210. Thus, the first purge passage 18*a* between the purge control valve 15 and the electromagnetic valve 16 is closed and tightly sealed.

This state represents the determination possible state where the existence of the abnormality in the first purge passage 18*a* is detectable.

At S220, the control device 3 acquires the detection signal of the pressure sensor 5 so as to detect the pressure in the first purge passage 18*a*. The control device 3 continues detecting the remained pressure in the first purge passage 18*a* that is closed for a predetermined period of time.

The abnormality determination circuit 30 determines whether a second abnormality condition is satisfied at S230. The second abnormality condition is a condition for determining whether abnormality such as leak is occurred in the first purge passage 18*a* in the determination possible state.

In the state where the first purge passage 18*a* is closed, when there is no leak in the passage, as shown in FIG. 5 representing the normal time, the pressure detected by the pressure sensor 5 is continuously fixed. On the contrary, when a leak is generated in the first purge passage 18*a*, since evaporation fuel leaks outside, as shown in FIG. 6 representing the abnormal time, the pressure detected by the pressure sensor 5 declines gradually with progress of time, and comes to approach atmospheric pressure.

The second abnormality condition shall be satisfied, for example, when a pressure decrease value per unit time (rate of pressure decrease) is more than or equal to a threshold value that is defined beforehand. The abnormality determination circuit 30 determines that there is abnormality when the rate of pressure decrease is more than or equal to the predetermined threshold value. When the rate of pressure decrease is less than the predetermined threshold value, it is determined that there is no abnormality.

When the abnormality determination circuit 30 determines that the second abnormality condition is not satisfied at S230, it is determined that an abnormality is generated in the second purge passage 18*b*, since the first purge passage 18*a* is normal (at S231). Furthermore, at S232, it is displayed that the abnormality is in the second purge passage 18*b* that is the target passage, and progresses to S260 to end the abnormality detection control. The display of abnormality in the second purge passage 18*b* is carried out by lighting or blinking a predetermined lamp by switching on and off, or by displaying an abnormality on a predetermined screen. Moreover, the display of abnormality may be substituted by generating a warning sound.

When the abnormality determination circuit 30 determines that the second abnormality condition is satisfied at S230, it is determined that an abnormality is generated in the first purge passage 18*a* (at S240). Furthermore, at S250, it is displayed that the abnormality is in the first purge passage 18*a*, and progresses to S260 to end the abnormality detection control. The display of abnormality in the first purge passage 18*a* is carried out by lighting or blinking a predetermined lamp by switching on and off, or by displaying an abnormality on a predetermined screen. Moreover, the display of abnormality may be substituted by generating a warning sound.

Figure 7:
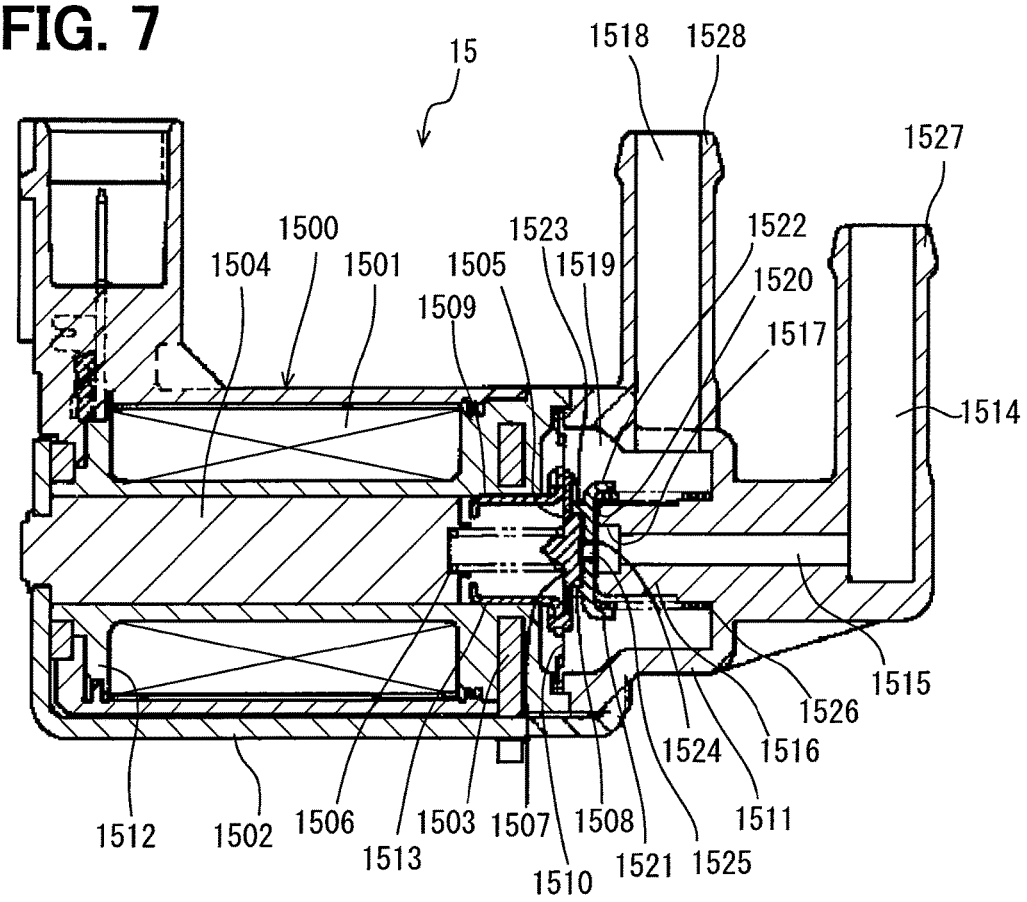
FIG. 7 is a sectional view illustrating a purge control valve in the first embodiment.

As shown in FIG. 7, the purge control valve 15 may be a valve device in which a valve object 1507 operates to close the passage when a fluid passage 1514 becomes to have negative pressure by operation of the internal combustion engine 2. The configuration of the purge control valve 15 in this case is explained with reference to FIG. 7.

The purge control valve 15 includes an electromagnetic solenoid 1500 having a coil 1501, a yoke 1502, a magnetic plate 1503, and a fixed iron core 1504. A movable object 1505 opposes the fixed iron core 1504 through a clearance in the axial direction. The movable object 1505 includes the valve object 1507 having a movable iron core 1509, a board spring 1510, and an elastic body such as rubber. The valve object 1507 is attached to the central part of the board spring 1510, and a circumference part of the board spring 1510 is interposed between the end frame 1511 and the coil bobbin 1512, such that the movable object 1505 is held with the board spring 1510. The board spring 1510 is formed to displace in the axial direction by movement of the movable object 1505. The movable iron core 1509 is movable in the axial direction due to a gap between the perimeter of the movable iron core 1509 and the inner circumference of the coil bobbin 1512, i.e., a bearing part 1513. The coil spring 1506 biases the movable object 1505 in a direction away from the fixed iron core 1504.

The end frame 1511 is connected and fixed to the electromagnetic solenoid 1500 through the yoke 1502. The end frame 1511 integrally has a port 1527 and a port 1528. The fluid passage 1514 is defined in the port 1527, and the fluid passage 1515 is formed to intersect perpendicularly to the fluid passage 1514. The fluid passage 1515 communicates to the opening 1517 at the end of the cylinder part 1516 integrally formed to the end frame 1511. The fluid passage 1518 is defined in the port 1528. The fluid passage 1519 is formed in the end frame 1511, and the fluid passage 1518 and the opening 1517 communicate with each other through the fluid passage 1519. The valve seat 1520 is formed at the tip part of the cylinder part 1516, and the seat part 1508 of the valve object 1507 is in contact with the valve seat 1520 or separates from the valve seat 1520.

A sub-valve object 1521 is loosely fitted to the circumference of the tip portion of the cylinder part 1516, and is defined by an opening at the center of the cap object 1522 in contact with the valve seat 1520. The annular protrusion part 1523 having the same center with the opening of the cap object 1522 is formed on the outer side of the cap object 1522. The annular protrusion part 1523 has the fluid passage with a cutout. A grommet 1524 is fitted to the edge of the opening of the cap object 1522. The grommet 1524 is made of elastic body such as synthetic rubber or soft synthetic resin, and has a choke opening 1525 passing through the grommet 1524 at the center in the axial direction. The seat part is formed on the surface in contact with the valve seat 1520, and the valve seat is formed on the opposite surface adjacent to the annular protrusion part 1523. The valve object 1507 at this time is made of elastic body such as rubber, or inelastic body such as metal or synthetic resin.

The sub-valve object 1521 is biased in a direction away from the valve seat 1520 by the coil spring 1526 engaged on the perimeter of the cylinder part 1516 integrally formed in the end frame 1511. However, the biasing force of the coil spring 1506 is larger than the biasing force of the coil spring 1526. The seat part 1508 of the valve object 1507 biased by the coil spring 1506 fits into the annular protrusion part 1523, so as to be seated on the valve seat. Furthermore, the valve object 1507 presses the sub-valve object 1521 in a manner that the seat part formed in the grommet 1524 is seated onto the valve seat 1520, so as to close the opening 1517.

The operation of the purge control valve 15 is as follows. When electricity is supplied to the electromagnetic solenoid 1500, and when the drawing force of the electromagnetic solenoid 1500 becomes larger than the biasing force of the coil spring 1506, the movable object 1505 is attracted toward the fixed iron core 1504, such that the fluid passage 1515 and the fluid passage 1518 communicate with each other through the fluid passage 1519.

Effects of the abnormality sensing device of the evaporation fuel purge system 1 of the first embodiment are explained. The evaporation fuel purge system 1 includes the purge control valve 15 that is able to allow or prohibit the supply of evaporation fuel to the intake passage 210 from the target passage which includes at least the first purge passage 18*a* that connects the purge control valve 15 to the intake passage 210 of the internal combustion engine. Furthermore, the evaporation fuel purge system 1 includes the abnormality determination circuit 30 which determines the existence of abnormality in the purge system in the determination possible state where evaporation fuel is pumped toward the intake passage 210 by the purge pump 14.

In the determination possible state, the abnormality determination circuit 30 detects the predetermined physical quantity relevant to the pressure change in the target passage, and determines the existence of abnormality in the system according to the detected predetermined physical quantity. The determination possible state represents a state where evaporation fuel is pumped toward the intake passage 210 by the purge pump 14, where the purge control valve 15 allows evaporation fuel to flow in the first purge passage 18*a*, and where supply of evaporation fuel to the intake passage 210 is prevented by the electromagnetic valve 16.

According to this, the existence of leak generated in the first purge passage 18*a* located between the intake passage 210 and the purge control valve 15 can be determined according to the detection value of the predetermined physical quantity relevant to the pressure change of the passage. Thereby, the existence of abnormality can be detected in the wide range of the purge passage 18 to the connection area in which the passage is connected to the intake passage 210.

Furthermore, since the detection of abnormality is performed at the time of operating the purge pump 14, the abnormality detection is possible regardless of operation or stop of the internal combustion engine 2. Therefore, since the abnormality existence can be determined at any suitable timing even under operation of the internal combustion engine 2, an abnormality such as leak is detectable at an early stage. For example, evaporation fuel can be restricted from being discharged to large area while the vehicle is driving. Furthermore, since the abnormality sensing device does not choose the detection timing, the abnormality detection processing can be performed with a short cycle.

Moreover, the abnormality determination processing can be completed in a short time by controlling the output of evaporation fuel with the purge pump 14. Furthermore, the abnormality sensing device can detect an abnormality that is generated during the vehicle is driving without affecting operation of the internal combustion engine 2.

In a comparison example of the leak sensing device, when the temperature in the fuel tank falls after the operation of internal combustion engine is stopped, negative pressure generates in the evaporation fuel passage. At this time, a purge control valve is closed in the state where the pump is not operated, and the pressure in the passage is monitored. A leak is detected by referring to the negative pressure at the normal time and the negative pressure at the abnormal time.

In contrast, according to the abnormality sensing device of the first embodiment, the pressure is controlled using the pump. Therefore, abnormality can be determined with high accuracy.

The electromagnetic valve 16 is placed in the intake pipe 21 which defines the intake passage 210 of the internal combustion engine, instead of the duct which defines the target passage. The electromagnetic valve 16 is not directly attached to the first purge passage 18*a*. Therefore, the electromagnetic valve 16 can make whole of the first purge passage 18*a* to be the closed space by closing the electromagnetic valve 16, and whole of the first purge passage 18*a* can be filled with evaporation fuel. Thus, abnormality such as leak can be determined relative to whole of the first purge passage 18*a*.

According to the first embodiment, when it is determined that there is abnormality in S50, the abnormality determination circuit 30 closes the purge control valve 15 to confine evaporation fuel in the first purge passage 18*a*, and detects the pressure change of the first purge passage 18*a* in the confine state. The abnormality determination circuit 30 determines the existence of abnormality in the first purge passage 18*a* according to the detected pressure change. When it is determined that there is no abnormality in the first purge passage 18*a*, it is determined that an abnormality is in the second purge passage 18*b*.

In other words, the abnormality detection is first performed relative to the passage from the purge pump 14 to the electromagnetic valve 16. When there is abnormality in the passage from the purge pump 14 to the electromagnetic valve 16, the abnormality detection is performed relative to the first purge passage 18*a* next. Thus, the position of the abnormality can be determined in the first purge passage 18*a*.

In contrast, when it is determined that there is no abnormality in the first purge passage 18*a*, it is determined that an abnormality is in the second purge passage 18*b*. The abnormality detection control can specify the location of the abnormality in the passage with the narrower range. When the location of the abnormality in the passage can be specified with the narrower range by the abnormality detection control, a component having the abnormality can be repaired or replaced quickly.

The purge control valve 15 has the valve object 1507 configured to close the passage when the first purge passage 18*a* adjacent to the electromagnetic valve 16 becomes to have negative pressure by operation of the internal combustion engine 2. Accordingly, when positive pressure acts to the electromagnetic valve 16 with the purge pump 14, evaporation fuel is difficult to leak to the intake passage 210 of the internal combustion engine.

Second Embodiment

An abnormality sensing device for an evaporation fuel purge system 101 according to a second embodiment is explained with reference to FIGS. 4, 8 and 9.

Figure 8:
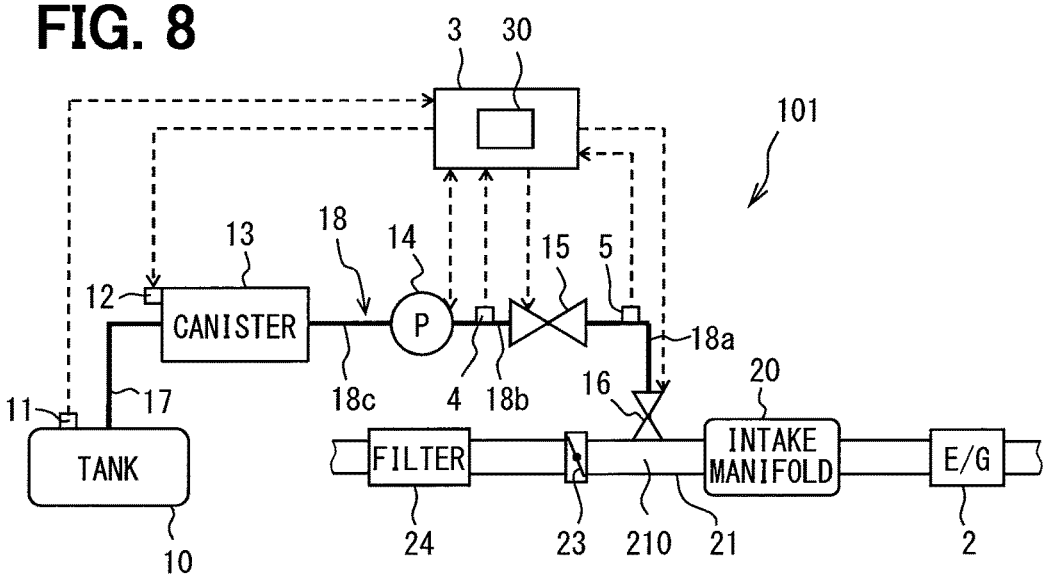
FIG. 8 is a block diagram illustrating an abnormality sensing device for an evaporation fuel purge system according to a second embodiment.

As shown in FIG. 8, the evaporation fuel purge system 101 further includes a pressure sensor 4, compared with the first embodiment. The pressure sensor 4 detects a pressure in the second purge passage 18*b*. The evaporation fuel purge system 101 can detect a pressure in a piping defining the second purge passage 18*b* ranged to the purge control valve 15 from the purge pump 14 using the detection value of the pressure sensor 4.

The input port of the control device 3 receives a signal corresponding to the pressure of the first purge passage 18*a* detected by the pressure sensor 5, and a signal corresponding to the pressure of the second purge passage 18*b* detected by the pressure sensor 4. The evaporation fuel purge system 101 determines an abnormality by utilizing the detection value of the pressure sensor 4 and the detection value of the pressure sensor 5.

The purge system 101 detects change in physical quantity relevant to pressure change in the target passage, and determines whether there is abnormality. The purge system 101 closes the electromagnetic valve 16, opens the purge control valve 15, and pumps evaporation fuel with the purge pump 14. In this state, a predetermined physical quantity relevant to the pressure change of the first purge passage 18*a* or the second purge passage 18*b* of the purge passage 18 is detected.

The purge system 101 determines the existence of abnormality in the system according to the pressure of each passage, which is detected as a physical quantity. In the purge system 101, the pressure of the first purge passage 18*a* or the second purge passage 18*b* of the target passage is raised using the purge pump 14. When a pressure change is detected as an abnormality, it is determined that a leak is occurred in at least one of the passages.

At a time of determining an abnormality existence, the purge control valve 15 is controlled to open, the electromagnetic valve 16 is controlled to be closed, and the purge pump 14 is operated. Since the first purge passage 18*a* and the intake passage 210 of the internal combustion engine are intercepted from each other by the electromagnetic valve 16, the first purge passage 18*a* is closed at the position of the electromagnetic valve 16. The purge pump 14 pumps evaporation fuel in this state. Therefore, the first purge passage 18*a* and the second purge passage 18*b* are tightly sealed and closed with a positive pressure.

In this state, when there is no leak in the first purge passage 18*a* and the second purge passage 18*b*, as shown in the pressure change at the normal time of FIG. 4, the pressure in the closed passage is raised rapidly by operation of the purge pump 14, and then is gradually raised with continuation of the operation.

On the contrary, when a leak exists in the passages, since evaporation fuel leaks outside, the pressure in the closed passage is not so much raised after operation of the purge pump 14, as shown in the pressure change at the abnormal time of FIG. 4. This is because evaporation fuel is emitted outside even while the purge pump 14 is operated.

In the purge system 101, when it is determined that there is abnormality based on the detection value of the pressure sensor 5, first, it is determined that a leak is located in either the first purge passage 18*a* or the second passage 18*b*. Next, the purge control valve 15 is closed to shut the second purge passage 18*b*, and determines whether there is an abnormality in this state based on the detection value of the pressure sensor 4. When it is determined that there is an abnormality based on the detection value of the pressure sensor 4, it is recognized that a leak is in the second purge passage 18*b*. When it is determined that there is no abnormality based on the detection value of the pressure sensor 4, it is recognized that a leak is in the first purge passage 18*a*.

The abnormality detection control of the second embodiment is explained with reference to the flow chart of FIG. 9. The control device 3 performs the processing according to the flow chart of FIG. 9. The flow chart of FIG. 9 operates irrespective of the operation state of the internal combustion engine 2.

When the flow chart is started, the control device 3 performs each processing corresponding to S10, S20, S30, S40, and S50 similarly to the first embodiment.

When the abnormality determination circuit 30 determines that the first abnormality condition is not satisfied at S50, the abnormality detection control should be ended. The control device 3 controls to open the electromagnetic valve 16 at S55, and progresses to S150. At S150, it is determined whether the predetermined time period is elapsed after executing the processing of S50. The processing of S150 is repeatedly performed until the next determination timing comes. When it is determined that the predetermined time period passes at S150, the abnormality determination circuit 30 returns to S10 and the processing of subsequent abnormality detection control is performed again. Thus, the abnormality detection control is performed at a predetermined time interval irrespective of the operation of the internal combustion engine 2.

When the abnormality determination circuit 30 determines that the first abnormality condition is satisfied at S50, the control device 3 closes the purge control valve 15 at S100 to detect the position of abnormality in detail. Since the evaporation fuel pumped with the purge pump 14 is stopped and accumulated at the position of the purge control valve 15, the second purge passage 18*b* is in the tightly closed state with a positive pressure.

The control device 3 continues and keeps this state for a predetermined period of time, so as to provide a determination possible state where the existence of abnormality in the second purge passage 18*b* is detectable. At S110, the control device 3 acquires the detection signal of the pressure sensor 4 to detect the pressure in the second purge passage 18*b*. The abnormality determination circuit 30 of the control device 3 determines whether the second abnormality condition is satisfied at S120. The second abnormality condition is a condition for determining whether abnormality such as leak is occurred in the second purge passage 18*b* in the determination possible state.

In this state, when there is no leak in the second purge passage 18*b*, the pressure in the closed passage is rapidly raised by operation of the purge pump 14, and then is gradually raised with continuation of the operation, as shown in the pressure change at the normal time of FIG. 4. On the contrary, when there is a leak in the second purge passage 18*b*, since evaporation fuel leaks outside, the pressure of the closed passage is not so much raised after operation of the purge pump 14, as shown in the pressure change at the abnormal time of FIG. 4.

The second abnormality condition shall be satisfied, for example, when the pressure change per unit time (rate of pressure change) is less than a second predetermined value. Therefore, the abnormality determination circuit 30 determines that there is abnormality when the rate of pressure change is less than the second predetermined value. When the rate of pressure change is more than or equal to the second predetermined value, the abnormality determination circuit 30 determines that there is no abnormality.

When the abnormality determination circuit 30 determines that the second abnormality condition is not satisfied at S120, since there is no abnormality in the second purge passage 18*b*, the abnormality determination circuit 30 determines that there is abnormality in the first purge passage 18*a* (at S121). Furthermore, at S122, it is displayed that the abnormality is in the first purge passage 18*a* that is the target passage, and progresses to S150 to end the abnormality detection control. The display of abnormality in the first purge passage 18*a* is carried out by lighting or blinking a predetermined lamp by switching on and off, or by displaying an abnormality on a predetermined screen. Moreover, the display of abnormality may be substituted by generating a warning sound.

When the abnormality determination circuit 30 determines that the second abnormality condition is satisfied at S120, it is determined that there is abnormality at least in the second purge passage 18*b* (at S130). Furthermore, at S140, it is displayed that the abnormality is in the second purge passage 18*b*, and progresses to S150 to end the abnormality detection control. The display of abnormality in the second purge passage 18*b* is carried out by lighting or blinking a predetermined lamp by switching on and off, or by displaying an abnormality on a predetermined screen. Moreover, the display of abnormality may be substituted by generating a warning sound.

According to the second embodiment, when it is determined that there is abnormality at S50, evaporation fuel is pumped with the purge pump 14, and the purge control valve 15 is closed such that evaporation fuel does not flow into the first purge passage 18*a*. The abnormality determination circuit 30 detects the pressure change of the second purge passage 18*b* that connects the purge pump 14 to the purge control valve 15 in this state, and determines the existence of abnormality in the second purge passage 18*b* according to the detected pressure change. When the abnormality determination circuit 30 determines that there is no abnormality in the second purge passage 18*b*, it is determined that abnormality is in the first purge passage 18*a*.

First, abnormality such as leak is determined in the passage ranged from the purge pump 14 to the electromagnetic valve 16. Then, when it is determined that there is abnormality, abnormality is determined to exist in the second purge passage 18*b*. When it is determined that there is abnormality in the second purge passage 18*b*, it is detectable that the abnormality is at least in the second purge passage 18*b*, of the passage ranged from the purge pump 14 to the electromagnetic valve 16. In this case, abnormalities may have occurred both in the first purge passage 18*a* and the second purge passage 18*b*.

When it is determined that there is no abnormality in the second purge passage 18*b*, it is detectable that an abnormality is in the first purge passage 18*a* ranged from the purge control valve 15 to the electromagnetic valve 16. Thus, the abnormality detection control can specify the position of the abnormality in the passage with the narrower range. When the location of the abnormality in the passage can be specified with the narrower range by the abnormality detection control, a component having the abnormality can be repaired or replaced quickly.

Third Embodiment

An abnormality sensing device for an evaporation fuel purge system 201 according to a third embodiment is explained with reference to FIGS. 10-13.

Figure 10:
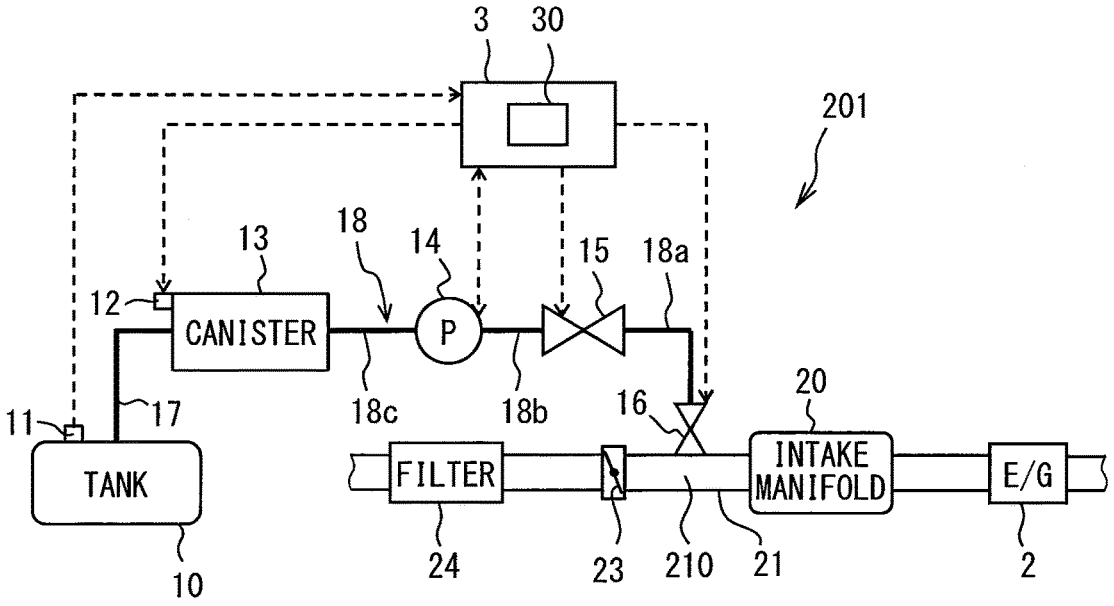
FIG. 10 is a block diagram illustrating an abnormality sensing device for an evaporation fuel purge system according to a third embodiment.

As shown in FIG. 10, the evaporation fuel purge system 201 is not equipped with the pressure sensor 5 compared with the first embodiment. The evaporation fuel purge system 201 detects a pressure change in the passage by utilizing another physical quantity without using the detection value of the pressure sensor 5 in the abnormality determination process.

The operation information of the purge pump 14 is inputted into the input port of the control device 3. The control device 3 analyzes the signal of operation information inputted from the purge pump 14, and calculates the consumption current or consumption voltage of the purge pump 14.

The purge system 201 detects change in physical quantity relevant to the pressure change in the first purge passage 18*a*, and determines whether there is abnormality. In the third embodiment, the power consumption, consumption current, or consumption voltage of the purge pump 14 is adopted as the physical quantity relevant to the pressure change in the first purge passage 18*a*.

Figure 12:
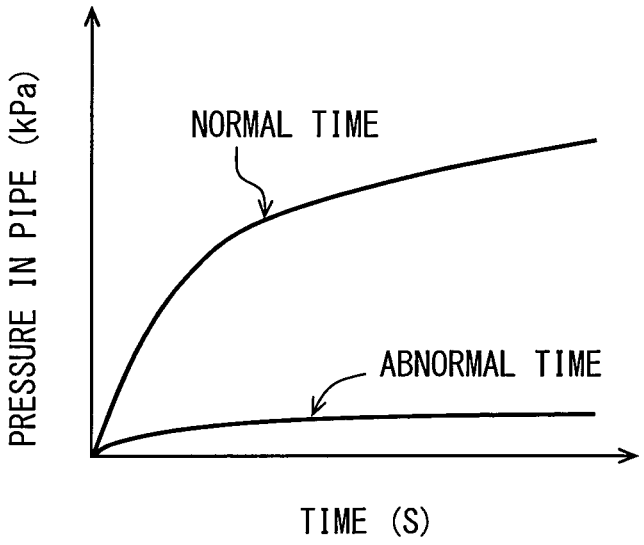
FIG. 12 is a graph illustrating a relationship between time and pressure change in a pipe defining a target passage in the third embodiment.
Figure 13:
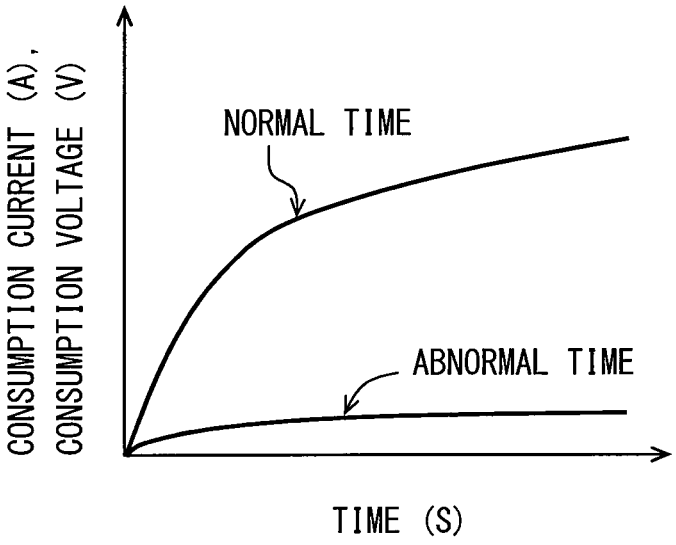
FIG. 13 is a graph illustrating a relationship between time and change in consumption current or consumption voltage of a purge pump in the third embodiment.

As shown in FIG. 12, the resistance received by the purge pump 14 is high at the normal time and is low at the abnormal time. There is a tendency that the power consumption, consumption current, and consumption voltage of the purge pump 14 becomes large at the normal time, and becomes small at the abnormal time. FIG. 13 illustrates change in the power consumption, e.g., consumption current and consumption voltage of the purge pump 14 for each of the abnormal time and the normal time.

Figure 11:
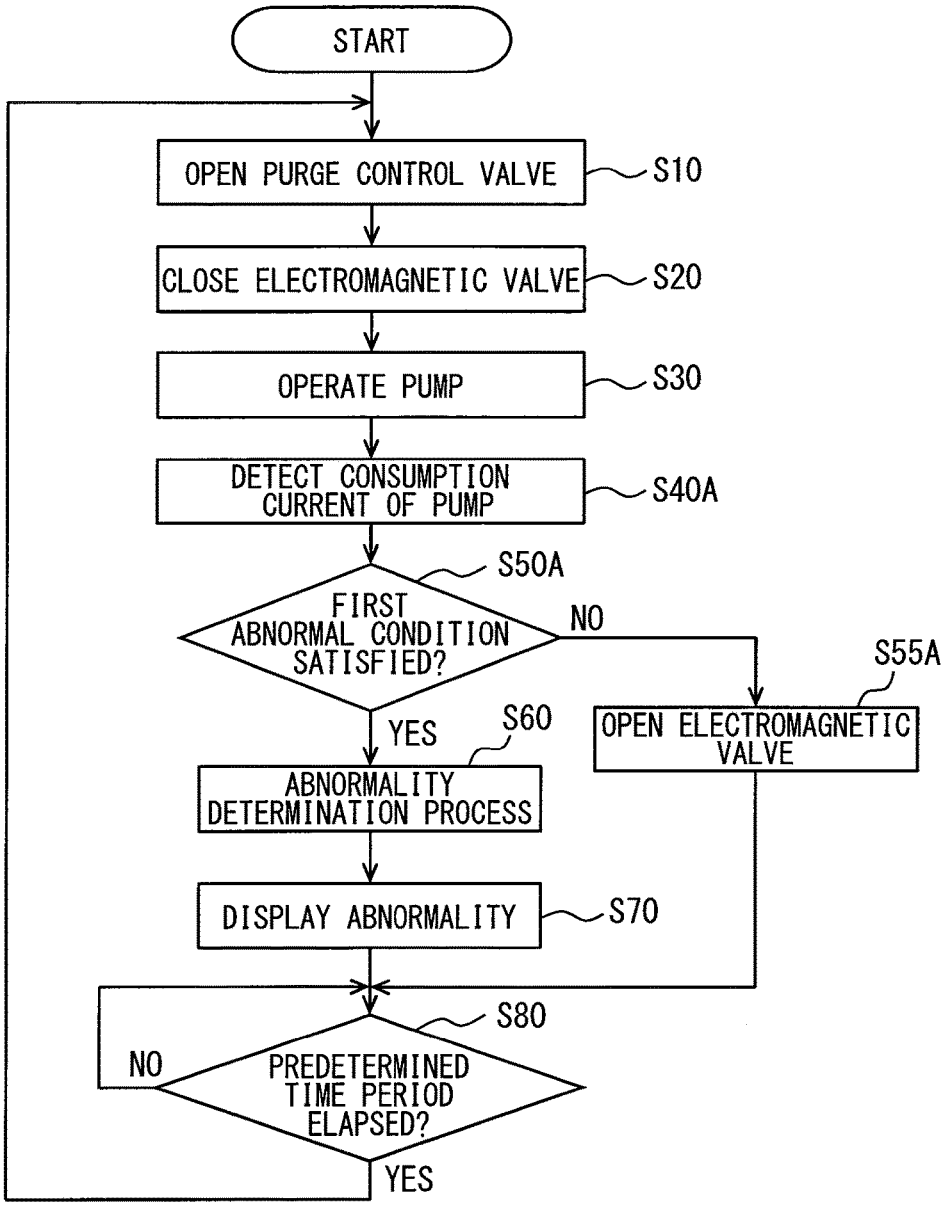
FIG. 11 is a flow chart explaining a determination process by the abnormality sensing device in the third embodiment.

The abnormality detection control of the third embodiment is explained with reference to the flow chart of FIG. 11. The control device 3 performs processing according to the flow chart of FIG. 11. The flow chart of FIG. 11 operates irrespective of the operation state of the internal combustion engine 2 of the vehicle.

When the flow chart is started, the control device 3 performs each processing corresponding to S10, S20, and S30. Since the evaporation fuel pumped with the purge pump 14 is stopped and accumulated at the position of the electromagnetic valve 16, the first purge passage 18*a* and the second purge passage 18*b* are in the tightly closed state with positive pressure.

The control device 3 keeps this state and continues for a predetermined period of time, and analyzes the signal of operation information inputted from the purge pump 14 at S40A to detect the consumption current of the purge pump 14. The consumption current may be replaced with consumption voltage or power consumption.

The abnormality determination circuit 30 of the control device 3 determines whether the first abnormality condition is satisfied at S50A. The first abnormality condition is a condition for determining whether abnormality, such as crack generated in a duct, have occurred in a target passage (the first purge passage 18*a* and the second purge passage 18*b*) in the determination possible state. The first abnormality condition shall be satisfied, for example, when the current change per unit time (current changing rate) is less than the first predetermined value. The abnormality determination circuit 30 determines that there is abnormality when the current changing rate is less than the first predetermined value. When the current changing rate is larger than or equal to the first predetermined value, the abnormality determination circuit 30 determines that there is no abnormality.

When the abnormality determination circuit 30 determines that the first abnormality condition is not satisfied at S50A, the abnormality detection control should be ended. The control device 3 opens the electromagnetic valve 16 at S55A, and progresses to S80. At S80, it is determined whether the predetermined time period is elapsed after performing the processing of S50A. That is, the processing of S80 is repeatedly performed until the next determination timing comes. When it is determined that the predetermined time period passes at S80, the abnormality determination circuit 30 returns to S10 and the processing of subsequent abnormality detection control is performed again. Thus, the abnormality detection control is performed at a predetermined time interval irrespective of the operation of the internal combustion engine 2.

When the abnormality determination circuit 30 determines that the first abnormality condition is satisfied at S50A, an abnormality determination process is performed at S60. Then, it is displayed that the abnormality is in the target passage at S70 and progresses to S80. The display of abnormality is carried out by lighting or blinking a predetermined lamp by switching on and off, or by displaying an abnormality on a predetermined screen. Moreover, the display of abnormality may be substituted by generating a warning sound.

According to the third embodiment, the abnormality determination circuit 30 detects the consumption current or consumption voltage of the purge pump 14, that is relevant to a pressure change in the target passage in the determination possible state, and determines the existence of abnormality in the system according to the detected consumption current or voltage. The target passage in this case includes the first purge passage 18*a* and the second purge passage 18*b*.

Accordingly, the abnormality determination circuit 30 detects the consumption current or consumption voltage as information relevant to the load of the purge pump 14, because the pressure change in the target passage acts on the purge pump 14 as resistance. The consumption current or consumption voltage in the purge pump 14 can be acquired easily in control of the purge pump 14 as the data. Therefore, the abnormality determination circuit 30 can detect the important information relevant to the pressure change in the target passage, without directly measuring pressure in the target passage. Thus, a sensor for exclusive use to detect the pressure in the target passage can be made unnecessary, such that the number of components can be reduced for the system.

Fourth Embodiment

Figure 14:
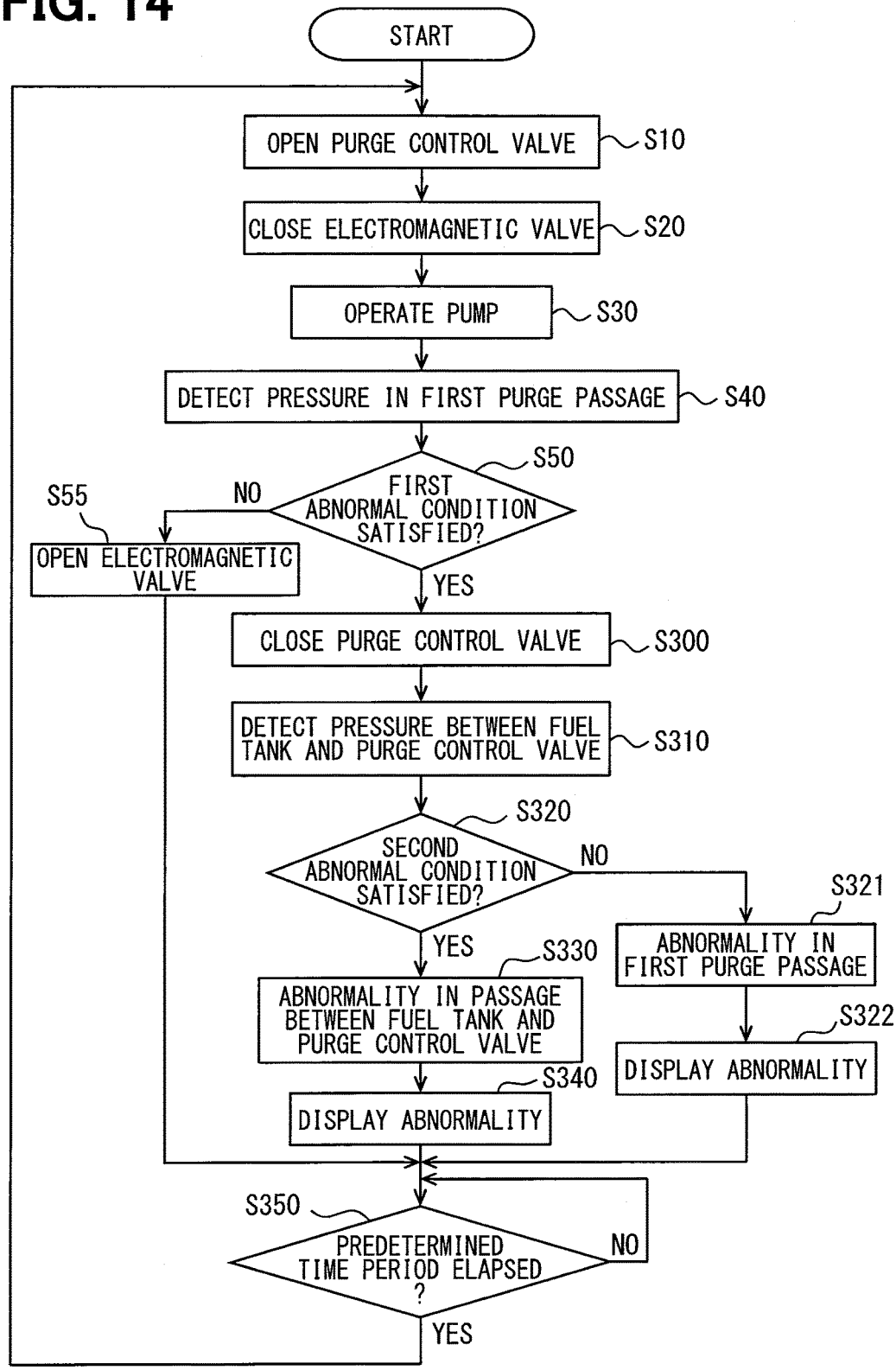
FIG. 14 is a flow chart explaining a determination process by an abnormality sensing device according to a fourth embodiment.

An abnormality sensing device for an evaporation fuel purge system according to a fourth embodiment is explained with reference to FIGS. 14-16.

Figure 9:
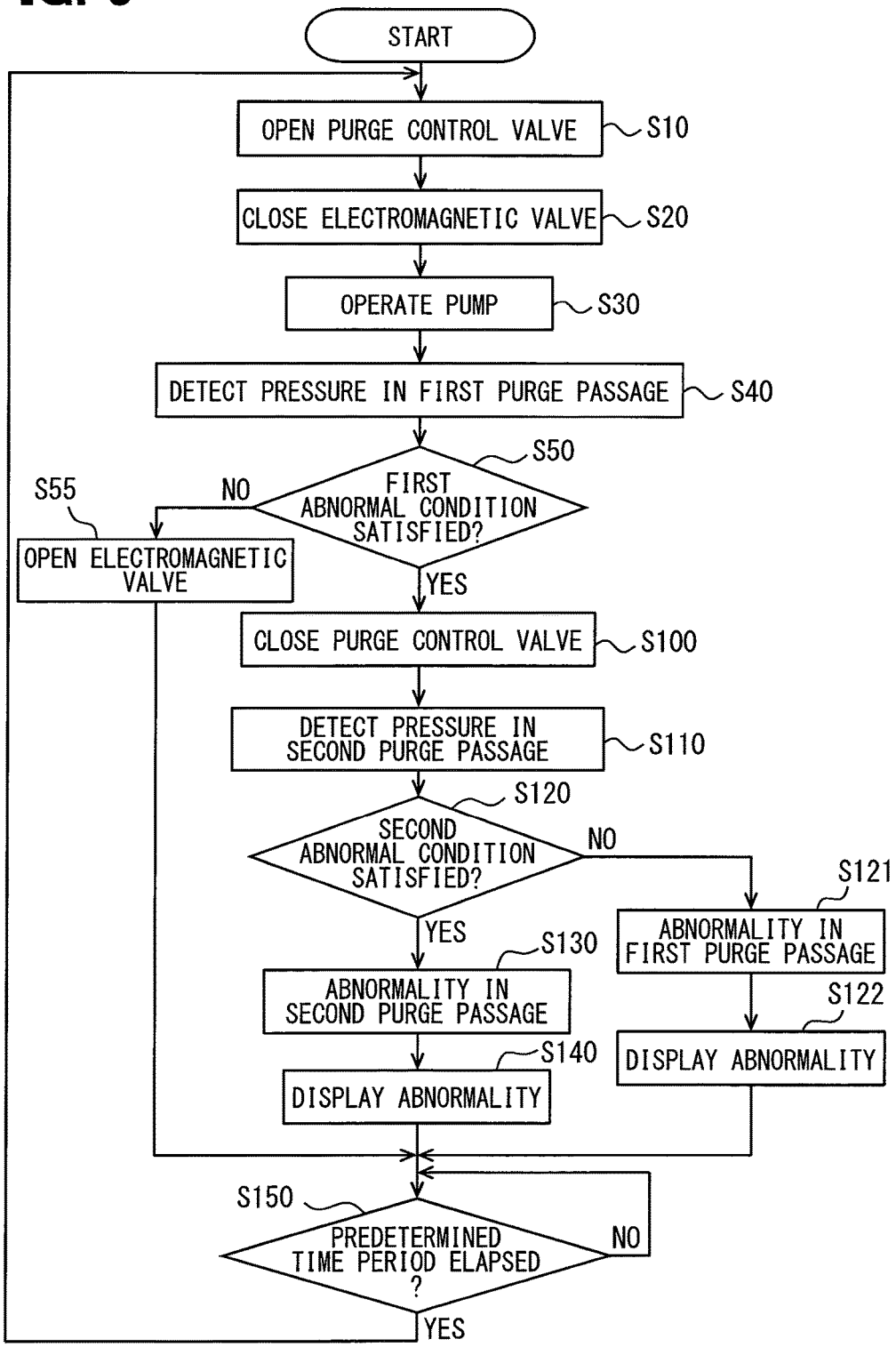
FIG. 9 is a flow chart explaining a determination process by the abnormality sensing device in the second embodiment.

The process after S30 of the fourth embodiment is different from the second embodiment shown in FIG. 9. The evaporation fuel purge system of the fourth embodiment is the same as the purge system 1 of the first embodiment shown in FIG. 1. In the fourth embodiment, the purge system determines an abnormality in the passage ranged from the purge control valve 15 to the fuel tank 10 using the pressure in the fuel tank 10 detected by the pressure sensor 11.

The abnormality detection control of the fourth embodiment is explained with reference to the flow chart of FIG. 14. The flow chart shows an abnormality detection control relative to both the first purge passage 18*a* and a tank side passage ranged from the purge control valve 15 to the fuel tank 10. According to the fourth embodiment, it is detectable whether an abnormality is generated in the first purge passage 18*a* or the tank side passage.

When the abnormality determination circuit 30 determines that the first abnormality condition is satisfied at S50, and when the control device 3 closes the purge control valve 15 at S300, this state is kept for a predetermined time period, such that the determination possible state is provided where the existence of abnormality in the tank side passage is detectable.

At S310, the control device 3 acquires a detection signal of the pressure sensor 11 to obtain the pressure in the fuel tank 10. The abnormality determination circuit 30 determines whether the second abnormality condition is satisfied at S320. The second abnormality condition of S320 is a condition for determining whether an abnormality such as leak occurs in the tank side passage in the determination possible state.

Figure 15:
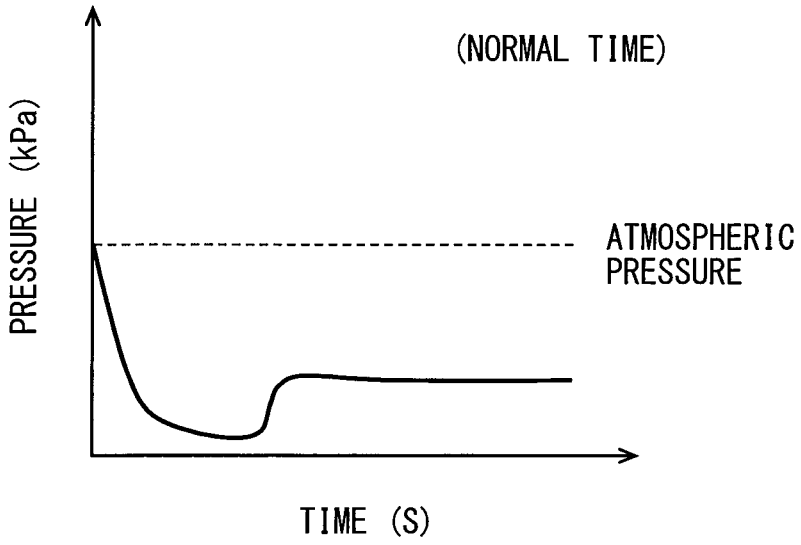
FIG. 15 is a graph illustrating a relationship between time and pressure change in a passage between a tank and a purge control valve at a normal time in the fourth embodiment.
Figure 16:
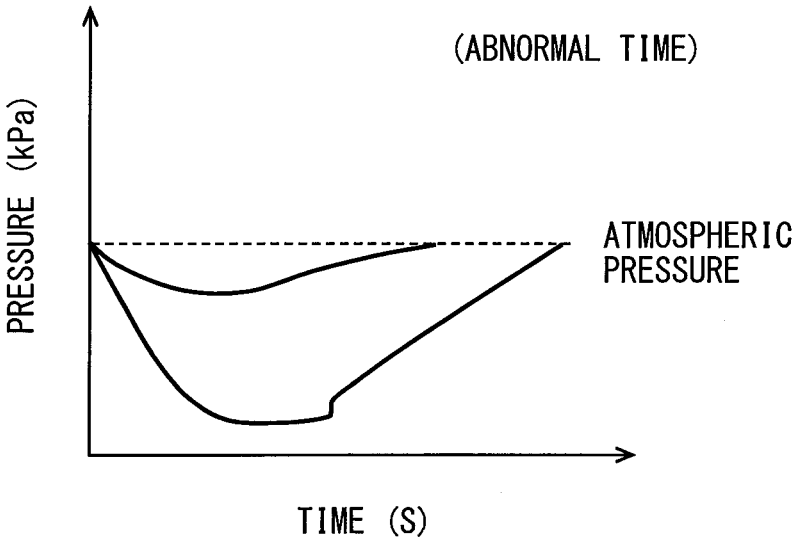
FIG. 16 is a graph illustrating a relationship between time and pressure change in a passage between a tank and a purge control valve at an abnormal time in the fourth embodiment.

In this state, as shown in a pressure change at a normal time of FIG. 15, when there is no leak in the tank side passage, the internal pressure of the fuel tank 10 is changed to negative pressure by operation of the purge pump 14. On the contrary, when there is a leak in the tank side passage, as shown in a pressure change (either of two solid lines) at an abnormal time of FIG. 16, the pressure approaches a positive level from the negative pressure after operation of the purge pump 14, as time passes, and the pressure in the tank comes to close to atmospheric pressure.

The second abnormality condition shall be satisfied, for example, when the detected pressure in the fuel tank 10 is more than or equal to a predetermined value. When the pressure in the fuel tank 10 is more than or equal to the predetermined value, the abnormality determination circuit 30 determines that there is abnormality, because the negative pressure is close to the atmospheric pressure compared with the normal-time value. When the negative pressure is less than the predetermined value, it is determined that there is no abnormality.

When it is determined that the second abnormality condition is not satisfied at S320, the abnormality determination circuit 30 determines that there is no abnormality in the tank side passage ranged from the purge control valve 15 to the fuel tank 10, and determines that there is abnormality in the first purge passage 18*a* (at S321). Furthermore, at S322, it is displayed that the abnormality is in the first purge passage 18*a*, and progresses to S350.

When it is determined that the second abnormality condition is satisfied at S320, the abnormality determination circuit 30 determines that there is abnormality at least in the tank side passage at S330. Furthermore, at S340, it is displayed that the abnormality is in tank side passage, and progresses to S350.

The display of abnormality in the passage ranged from the fuel tank 10 to the purge control valves 15 is carried out by lighting or blinking a predetermined lamp by switching on and off, or by displaying an abnormality on a predetermined screen. Moreover, the display of abnormality may be substituted by generating a warning sound.

According to the fourth embodiment, abnormality existence is first determined in the passage ranged from the purge pump 14 to the electromagnetic valve 16. When it is determined that there is abnormality, next, abnormality existence is determined relative to the tank side passage ranged from the fuel tank 10 to the purge control valve 15. At this time, it is detectable that abnormality is at least in the tank side passage, of the passage ranged from the fuel tank 10 to the electromagnetic valve 16, when it is determined that there is abnormality in the tank side passage.

When it is determined that there is no abnormality in the tank side passage, it is detectable that abnormality is in the first purge passage 18*a*. Thus, the abnormality detection control can specify more concretely the position of abnormality in the passage. When the location of the abnormality in the passage can be specified with the narrower range by the abnormality detection control, a component having the abnormality can be repaired or replaced quickly.

Other Embodiment

The embodiments may be modified without being restricted to the disclosure, not to deviate from the scope of the present disclosure.

In the second embodiment, an abnormality is determined using the pressure detected by the pressure sensor 4 or the pressure sensor 5. Alternatively, consumption current and consumption voltage of the purge pump 14 may be used, which is obtained by analyzing the signal of operation information inputted from the purge pump 14.

At S50 of the second embodiment, the abnormality determination circuit 30 may determine whether the first abnormality condition is satisfied using the pressure of the second purge passage 18*b* detected by the pressure sensor 4, not by the pressure sensor 5. In this case, at S40, the pressure sensor 4 detects the pressure of the second purge passage 18*b*. An abnormality in the first purge passage 18*a* and the second purge passage 18*b* can be detected using the pressure of this passage.

At S50A of the third embodiment, the abnormality determination circuit 30 may determine whether the first abnormality condition is satisfied by the following methods.

For example, the control device 3 beforehand memorizes a map in a memory, which represents a change at normal time and a change at abnormal time, as shown in FIG. 12, that are related with consumption current. In this case, the abnormality determination circuit 30 determines whether the first abnormality condition is satisfied by determining the data detected at S40A to resemble the normal time map or the abnormal time map. The abnormality determination circuit 30 determines that there is abnormality when the data detected at S40A resembles the abnormal time map. When the data detected at S40A is approximately similar to the normal time map, it is determined that there is no abnormality.

Such changes and modifications are to be understood as being within the scope of the present disclosure as defined by the appended claims.

What is claimed is:

1. An abnormality sensing device for an evaporation fuel purge system comprising:

a fuel tank storing fuel;

a canister that adsorbs evaporation fuel generated in the fuel tank and that desorbs the evaporation fuel;

an intake passage of an internal combustion engine in which the evaporation fuel desorbed from the canister is mixed with fuel for combustion to be combusted;

a purge passage that connects the canister to the intake passage of the internal combustion engine;

a purge pump that pumps the evaporation fuel from the canister to the intake passage of the internal combustion engine;

a purge control valve disposed in the purge passage to control a flow of the evaporation fuel pumped by the purge pump to flow through the purge passage;

a valve component that closes and opens the purge passage to control the evaporation fuel to flow into the intake passage of the internal combustion engine at a target passage of the purge passage, the target passage including at least a first passage defined between the purge control valve and the intake passage of the internal combustion engine; and an abnormality determining portion that determines whether there is an abnormality in the evaporation fuel purge system in a state where the evaporation fuel is pumped by the purge pump toward the intake passage of the internal combustion engine, wherein the abnormality determining portion is in a determination possible state when the evaporation fuel is pumped toward the intake passage of the internal combustion engine by the purge pump, when the purge control valve allows the evaporation fuel to flow through the first passage, and when the valve component prohibits the evaporation fuel from being supplied to the intake passage of the internal combustion engine, the abnormality determining portion detects a predetermined physical quantity relevant to a pressure change in the target passage in the determination possible state, and determines whether there is an abnormality in the evaporation fuel purge system according to the predetermined physical quantity, the purge passage comprising a second passage, the purge pump and the purge control valve being connected with each other by the second passage which is defined between the purge pump and the purge control valve, the purge passage further comprising a third passage, wherein an end of piping which defines the third passage is connected to an outflow part of the canister and the other end of the piping which defines the third passage is connected to an inflow part of the purge pump so that the third passage is defined between the canister and the inflow part of the purge pump, the first passage is defined between an outflow part of the purge control valve and an inflow part of the valve component, the evaporation fuel purge system further comprises a pressure sensor configured to detect the pressure in the first passage, and the predetermined physical quantity is a consumption current or consumption voltage of the purge pump.

2. The abnormality sensing device according to claim 1, wherein the predetermined physical quantity also includes a pressure detected in the first passage.

3. The abnormality sensing device according to claim 1, wherein the purge control valve has a valve object that is configured to operate to close the purge passage when a first purge passage adjacent to the valve component has a negative pressure by operation of the internal combustion engine.

4. The abnormality sensing device according to claim 1, wherein the canister, the purge pump, and the purge control valve are connected in order.

5. The abnormality sensing device according to claim 1, wherein an end of piping which defines a second purge passage is connected to an outflow part of the purge pump, and the other end of the piping which defines the second purge passage is connected to an inflow part of the purge control valve.

6. The abnormality sensing device according to claim 1, wherein the valve component is controlled to open or close the purge passage by a signal output from the abnormality determining portion.

7. The abnormality sensing device according to claim 1, wherein the pressure sensor configured to detect the pressure in a first purge passage is located between the purge control valve and the valve component.

8. The abnormality sensing device according to claim 1, further comprising:

a cylindrical connector that has a cylindrical shape extending from the duct component which defines the intake passage of the internal combustion engine, wherein the valve component is disposed inside of the cylindrical connector that is connected to a duct which defines the target passage, and is able to open and close a passage in the cylindrical connector.

9. The abnormality sensing device according to claim 1, the valve component is located at an intersection of the first passage and the intake passage.

10. An abnormality sensing device for an evaporation fuel purge system comprising:

a fuel tank storing fuel;

a canister that adsorbs evaporation fuel generated in the fuel tank and that desorbs the evaporation fuel;

an intake passage of an internal combustion engine in which the evaporation fuel desorbed from the canister is mixed with fuel for combustion to be combusted;

a purge passage that connects the canister to the intake passage of the internal combustion engine;

a purge pump that pumps the evaporation fuel from the canister to the intake passage of the internal combustion engine;

a purge control valve disposed in the purge passage to control a flow of the evaporation fuel pumped by the purge pump to flow through the purge passage;

a valve component that closes and opens the purge passage to control the evaporation fuel to flow into the intake passage of the internal combustion engine at a target passage of the purge passage; and an abnormality determining portion that determines whether there is an abnormality in the evaporation fuel purge system in a state where the evaporation fuel is pumped by the purge pump toward the intake passage of the internal combustion engine, wherein the target passage includes a first passage defined between the purge control valve and the intake passage of the internal combustion engine, and a second passage defined between the purge pump and the purge control valve, the abnormality determining portion is in a determination possible state when the evaporation fuel is pumped toward the intake passage of the internal combustion engine by the purge pump, when the purge control valve allows the evaporation fuel to flow through the first passage, and when the valve component prohibits the evaporation fuel from being supplied to the intake passage of the internal combustion engine, the abnormality determining portion detects a predetermined physical quantity relevant to a pressure change in the target passage in the determination possible state, and determines whether there is an abnormality in the evaporation fuel purge system according to the predetermined physical quantity, when the abnormality determining portion determines that the evaporation fuel purge system is abnormal in the determination possible state, as a first passage prohibition state, the purge pump pumps the evaporation fuel toward the intake passage of the internal combustion engine, and the purge control valve controls the evaporation fuel not to flow through the first passage, in the first passage prohibition state, the abnormality determining portion detects a pressure change in the second passage, and determines whether there is an abnormality in the second passage according to the pressure change, and the abnormality determining portion determines that an abnormality is generated in the first passage when it is determined that there is no abnormality in the second passage.

11. An abnormality sensing device for an evaporation fuel purge system comprising:

a fuel tank storing fuel;

a canister that adsorbs evaporation fuel generated in the fuel tank and that desorbs the evaporation fuel;

an intake passage of an internal combustion engine in which the evaporation fuel desorbed from the canister is mixed with fuel for combustion to be combusted;

a purge passage that connects the canister to the intake passage of the internal combustion engine;

a purge pump that pumps the evaporation fuel from the canister to the intake passage of the internal combustion engine;

a purge control valve disposed in the purge passage to control a flow of the evaporation fuel pumped by the purge pump to flow through the purge passage;

a valve component that closes and opens the purge passage to control the evaporation fuel to flow into the intake passage of the internal combustion engine at a target passage of the purge passage; and an abnormality determining portion that determines whether there is an abnormality in the evaporation fuel purge system in a state where the evaporation fuel is pumped by the purge pump toward the intake passage of the internal combustion engine, wherein the target passage includes a first passage defined between the purge control valve and the intake passage of the internal combustion engine, and a second passage defined between the purge pump and the purge control valve, the abnormality determining portion is in a determination possible state when the evaporation fuel is pumped toward the intake passage of the internal combustion engine by the purge pump, when the purge control valve allows the evaporation fuel to flow through the first passage, and when the valve component prohibits the evaporation fuel from being supplied to the intake passage of the internal combustion engine, the abnormality determining portion detects a predetermined physical quantity relevant to a pressure change in the target passage in the determination possible state, and determines whether there is an abnormality in the evaporation fuel purge system according to the predetermined physical quantity, when the abnormality determining portion determines that the evaporation fuel purge system is abnormal in the determination possible state, as a first passage confined state, the purge control valve is closed to confine the evaporation fuel in the first passage, in the first passage confined state, the abnormality determining portion detects a pressure change in the first passage, and determines whether there is an abnormality in the first passage according to the pressure change, and the abnormality determining portion determines that an abnormality is generated in the second passage when it is determined that there is no abnormality in the first passage.

* * * * *